US005409050A

United States Patent [19]

Hong

[11] Patent Number: 5,409,050

[45] Date of Patent: Apr. 25, 1995

[54] VENETIAN BLIND

[76] Inventor: Amy Hong, No. 9, Jenn-Shing Lane, Fu-Nan Village, Fu-Shing Hsiang, Changhua Shiann, Taiwan, Prov. of China

[21] Appl. No.: 125,759

[22] Filed: Sep. 24, 1993

[51] Int. Cl.[6] ..... E06B 9/30

[52] U.S. Cl. ..... 160/168.1; 160/236

[58] Field of Search ..... 160/168.1 R, 172 R, 160/173 R, 176.1 R, 178.1 R, 236, 166.1 R

[56] References Cited

U.S. PATENT DOCUMENTS

| | | | |
|---|---|---|---|
| 1,590,886 | 6/1926 | Carella | 160/176.1 R |
| 2,603,286 | 7/1952 | Miao | 160/236 X |
| 2,646,115 | 7/1953 | Bucher et al. | 160/173 R |
| 2,690,215 | 9/1954 | Croxen | 160/173 R |
| 2,757,727 | 8/1956 | Findell | 160/168.1 R |
| 3,032,099 | 5/1992 | Croxen | 160/168.1 R |
| 5,165,459 | 11/1992 | Gaber et al. | 160/168.1 R |

*Primary Examiner*—David M. Purol

*Attorney, Agent, or Firm*—Browdy and Neimark

[57] ABSTRACT

A Venetian blind comprises a top rail, a tilting device, two or more ladders, a bottom rail, a predetermined number of drawing cords, a drawing cord pulley retainer, and a predetermined number of slats. Each of the slats is provided with a through hole corresponding in location to a drawing cord, and with a ladder hole corresponding in location to each of ladders, and further with a slit extending in a predetermined direction from the ladder hole. The ladder has two suspension cords, one of which is received in the ladder hole through the slit. Each of the slats is provided with an extension section with an outer side edge and an inner side edge. The outer side edge of the extension section of one slat is capable of forming a lap joint with the inner side edge of the extension section of another slat at the time when the slats are set to keep out the light. The lap joint serves to obstruct the through holes and to conceal the ladders and the drawing cords.

8 Claims, 5 Drawing Sheets

VENETIAN BLIND

FIELD OF THE INVENTION

The present invention relates generally to a Venetian blind, and more particularly to a Venetian blind which can be so set as to keep out the light completely and which is provided with means to conceal ladders and drawing cords.

BACKGROUND OF THE INVENTION

As shown in FIGS. 1–4, a typical Venetian blind 10 of the prior art comprises a top rail 11, a tilting device 12, two ladders 14, a bottom rail 15, a predetermined number of slats 16, two drawing cords 17, a drawing cord pulley retainer 18.

The top rail 11 is fastened to a wall or a window sash. The tilting device 12 is pivoted to the inside of the top rail 11 such that its adjusting rod 13 emerges from one side of the top rail 11. The two ladders 14 are fastened respectively at one end thereof with the tilting device 12, with another end of each of the two ladders 14 being suspended. Each of the two ladders 14 comprises two parallel suspension cords 141. Located between the two parallel suspension cords 141 are a plurality of rungs 142 which are spaced equidistantly. The bottom rail 15 is disposed at the bottom ends of the ladders 14 such that the bottom rail 15 is parallel to the top rail 11. The slats 16 are held respectively between the two suspension cords 141 of the ladders 14 and are supported by the rungs 142. The slats 16 are spaced equidistantly and parallel to one another. Each of the slats 16 is provided with a through hole 161 corresponding in location to the ladder 14. In other words, the through holes 161 of the slats 16 are aligned. The tilting device 12 controls the upward and the downward movements of the suspension cords 141 of the two ladders 14. Such upward and downward movements of the suspension cords 141 set the slats 16 in a horizontal position and an upright position. Thus, the slats 16 can be set by the suspension cords 141 at any angle to regulate the light and the air passing through. The two drawing cords 17 are fastened respectively at one end thereof with the bottom rail 15, with another end of each of the two drawing cords 17 passing through the through hole 161 of the slats 16 before emerging from the top rail 11. The drawing cords 17 are intended to raise the bottom rail 15 so as to cause the slats 16 to be drawn up together to the top of the window. In addition, the slats 16 that are drawn up together to the top of the window can be lowered to the bottom of the window by means of the drawing cords 17. The drawing cord pulley retainer 18 is disposed at one side of the top rail 11 for locating the drawing cords 17.

The through hole 161 of each of the slats 16 is oval in shape and normal to the center line 162 of the slat 16, as shown in FIG. 4. As a result, the slats 16 do not make contact with the drawing cords 17 at the time when the slats 16 are set obliquely. However, when the slats 16 are so adjusted as to keep out the light completely, all through holes 161 of the Venetian blind 10 are visible, as shown in FIG. 3. Thus, the light can still pass through the through holes 161. In addition, when the slats 16 are set in an upright position to keep out the light, the ladders 14 are so visible that they undermine the aesthetic effect of the Venetian blind 10.

SUMMARY OF THE INVENTION

It is therefore the primary objective of the present invention to provide an improved Venetian blind capable of keeping out the light completely.

It is another objective of the present invention to provide an improved Venetian blind with the ladders and the drawing cords which are concealed at the time when the slats of the Venetian blind are set in an upright position to keep out the light.

The foregoing objectives of the present invention are attained by the improved Venetian blind, which comprises a top rail, a tilting device, two or more ladders, a bottom rail, a plurality of slats, a plurality of drawing cords, and a drawing cord pulley retainer.

The top rail is fastened to a window sash. The tilting device is pivoted to the top rail. Each of the ladders is fastened at one end thereof to the tilting device, with another end of each of the ladders being suspended. Each of the ladders comprises two suspension cords parallel to each other. Located between the two suspension cords are a plurality of rungs which are spaced equidistantly. The bottom rail is disposed at the bottom ends of the ladders and is parallel to the top rail. The slats are held horizontally by the ladders and supported by the rungs in such a manner that the slats are spaced equidistantly and parallel to one another. Each of the slats is provided with two or more through holes. The through holes of one slat are corresponding in location to the through holes of the neighboring slats. The tilting device regulates the upward and the downward movements of the two suspension cords of each of the ladders, so as to cause the slats to be set in a horizontal position to permit the light to pass through or to cause the slats to be set in an upright position to keep out the light. Each of the drawing cords has one end that is fastened with the bottom rail and has another end that is put through the corresponding through holes of the slats before emerging from the top rail. The drawing cords are intended to raise or lower the bottom rail. Thus, the slats can be drawn up together to the top of the window by means of the drawing cords, which are used to raise the bottom rail. The drawing cord pulley retainer is disposed in one end of the top rail for locating the drawing cords. The present invention is characterized in that the slats are provided respectively with two ladder holes corresponding in location to the ladders, and with two slits extending from the ladder holes to reach the edge of the same long side of the slats. One suspension cord of the ladder is received in the ladder hole through the slit so as to form in the slat an extension section by the ladder. When the slats are so set as to keep out the light, the outer side edge of the extension section of one slat is lapped with the inner side edge of the extension section of another slat located immediately under that one slat, so as to conceal the ladders and the drawing cords.

BRIEF DESCRIPTION OF THE DRAWINGS

FIG. 1 is a schematic view showing that the slats of a prior art Venetian blind are so set as to permit the light to pass through.

FIG. 7 is a schematic view showing that the slats of the first preferred embodiment of the present invention are so set as to permit the light to pass through.

FIG. 15 is a schematic view showing that the slats of the fourth preferred embodiment of the present invention are so set as to let the light pass through.

DETAILED DESCRIPTION OF THE INVENTION

The Venetian blind of the present invention comprises a top rail, a tilting device, two or more ladders, a bottom rail, a predetermined number of slats, a predetermined number of drawing cords equal in number to the through holes of the slat, and a drawing cord pulley retainer. In general, the Venetian blind of the present invention is similar in structure to the Venetian blind of the prior art. However, the Venetian blind of the present invention is different in structure from that of the prior art in certain aspects, which are described hereinafter.

Figure 8:
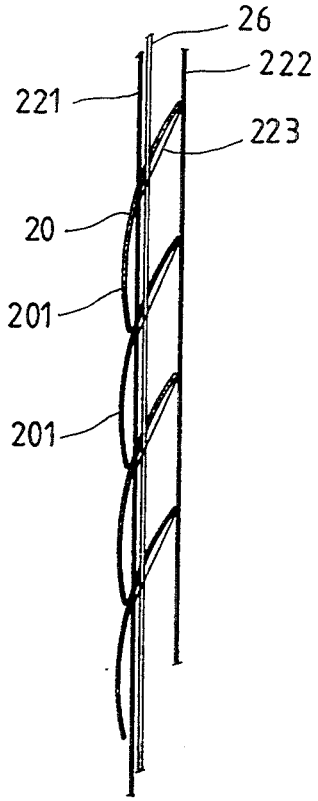
FIG. 8 is a schematic view showing that the slats of the first preferred embodiment of the present invention are so set as to keep out the light.
Figure 15:
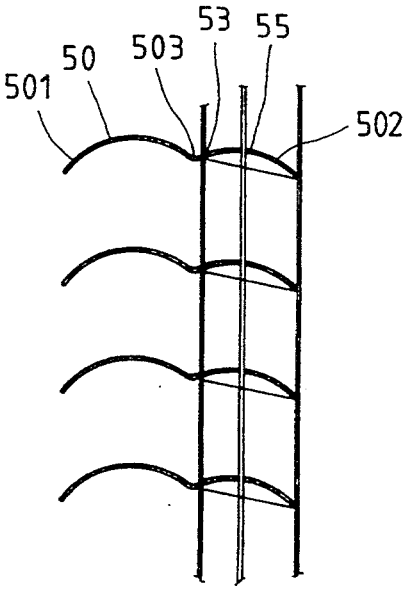

As shown in FIGS. 5–8, the Venetian blind of the first preferred embodiment of the present invention is characterized in that its slat 20 is provided with two ladder holes 23 which are located respectively near both ends of the long side of the slat 20 and at a predetermined distance from a center line 21 drawn along the longitudinal axis of the slat 20. Both ladder holes 23 are corresponding in location to two ladders 22 and provided respectively with a slit 24 extending in the same direction toward the edge of the same long side of the slat 20. Located by the ladder hole 23 is a through hole 25 for receiving therein a drawing cord 26. The ladder 22 has one suspension cord 221 that is received in the ladder hole 23 through the slit 24 and another suspension cord 222 which is so situated that its rung section 223 supports the slat 20. As a result, an extension section 201 is formed near the inner suspension cord 221 of the ladder 22. When the slats 20 are so set as to keep out the light, as shown in FIG. 8, the outer side edge of the extension section 201 of an upper slat 20 is lapped with the inner side edge of the extension section 201 of a lower slat 20 located immediately under the upper slat 20, thereby obstructing the through holes 25 and concealing the ladders 22 and the drawing cords 26.

Figure 3:
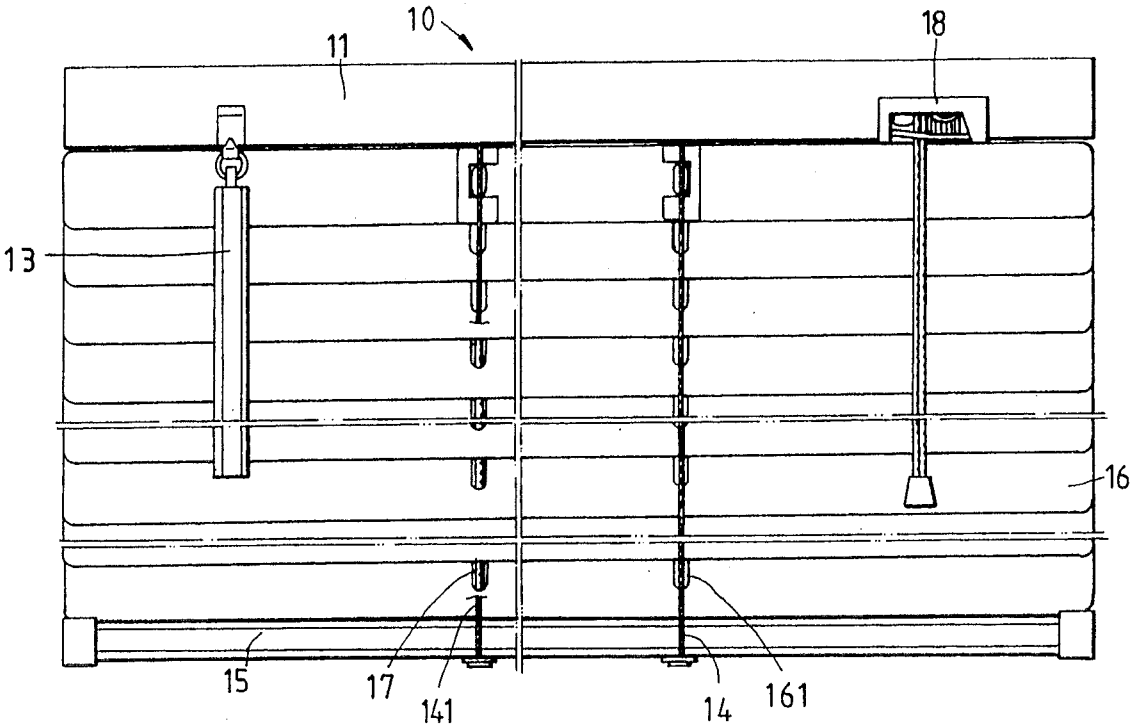
FIG. 3 PRIOR ART
FIG. 3 is a side elevational view of the prior art Venetian blind as shown in FIG. 2.
Figure 4:
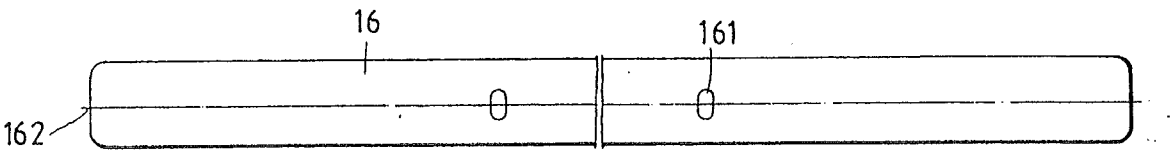
FIG. 4 PRIOR ART
FIG. 4 is a top plan view of the slat of the prior art Venetian blind as shown in FIG. 3.
Figure 2:
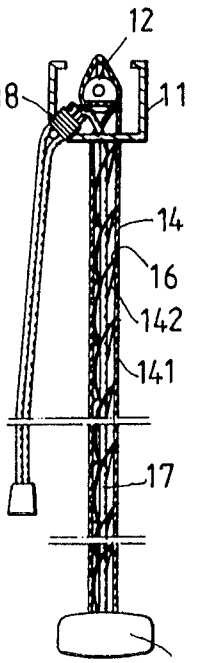
FIG. 2 PRIOR ART
FIG. 2 is similar to FIG. 1, with the difference being that the slats are so set as to keep out the light.
Figure 1:
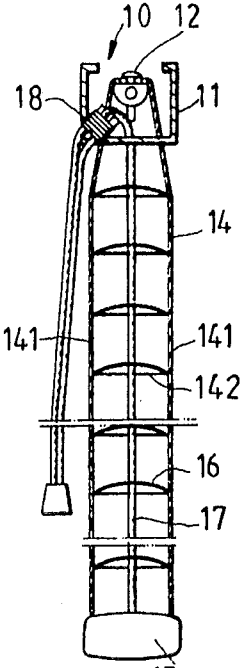
FIG. 1 PRIOR ART
Figure 5:
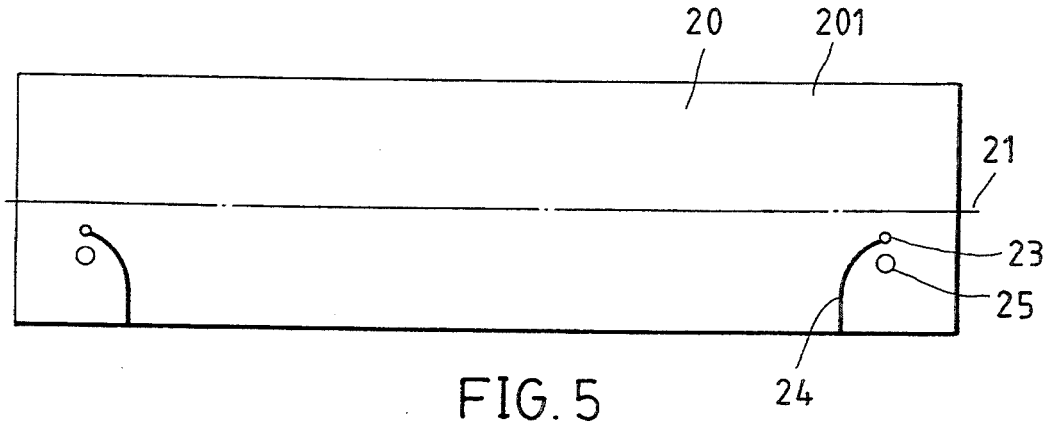
FIG. 5 shows a top plan view of the slat of a first preferred embodiment of the present invention.
Figure 6:
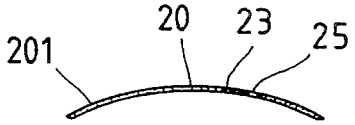
FIG. 6 shows an end view of the slat of the first preferred embodiment of the present invention.
Figure 9:
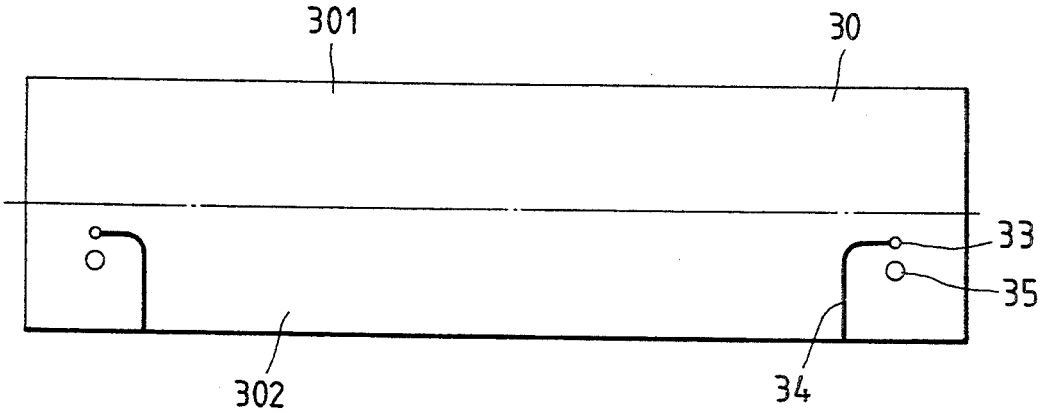
FIG. 9 shows a top plan view of the slat of a second preferred embodiment of the present invention.
Figure 10:
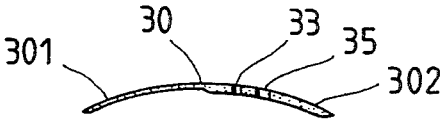
FIG. 10 shows an end view of the slat of the second preferred embodiment of the present invention.
Figure 7:
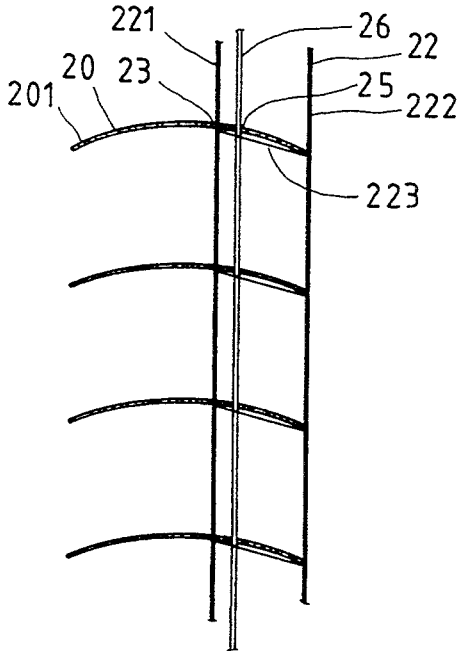

As shown in FIGS. 9 and 10, a slat 30 of the second preferred embodiment of the present invention is basically similar in shape and construction to the slat 20 of the first preferred embodiment of the present invention, with the difference being that the slat 30 is not uniform in thickness, and that the slat 30 is provided with a thick side 302 on which two ladder holes 33, two slits 34 and two through holes 35 are disposed. The thick side 302 is intended to reinforce the structural strength of the slat 30 having an extension section 301 which is thinner than the thick side 302.

Figure 11:
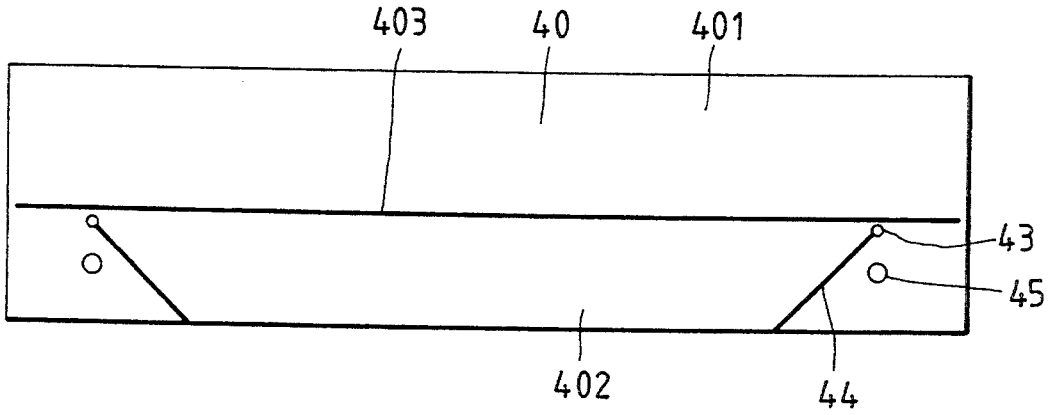
FIG. 11 shows a top plan view of the slat of a third preferred embodiment of the present invention.
Figure 12:
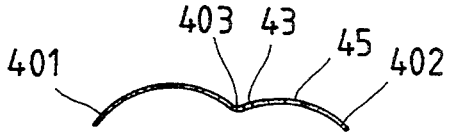
FIG. 12 shows an end view of the slat of the third preferred embodiment of the present invention.

As shown in FIGS. 11 and 12, a slat 40 of the third preferred embodiment of the present invention is provided with a large arcuate section 401 forming an extension section, and with a small arcuate section 402 provided with two ladder holes 43, two slits 44 and two through holes 45. Located between the large arcuate section 401 and the small arcuate section 402 is a groove 403. The slat 40 is relatively strong in structure.

Figure 16:
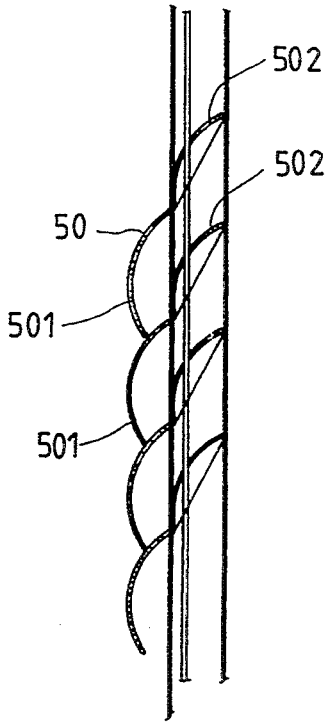
FIG. 16 is a schematic view showing that the slats of the fourth preferred embodiment of the present invention are so set as to keep out the light.
Figure 13:
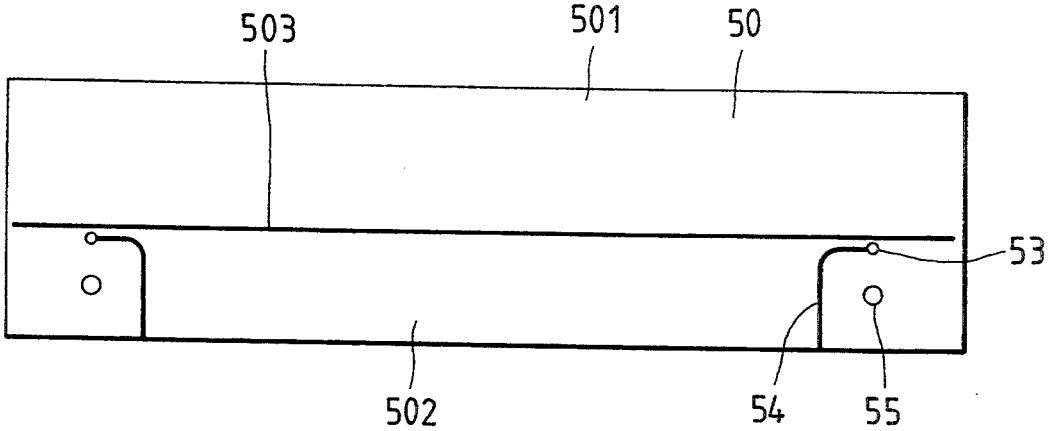
FIG. 13 shows a top plan view of the slat of a fourth preferred embodiment of the present invention.
Figure 14:
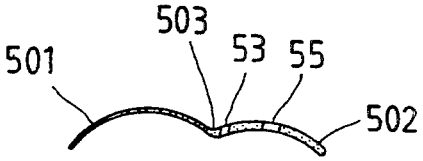
FIG. 14 shows an end view of the slat of the fourth preferred embodiment of the present invention.
Figure 17:
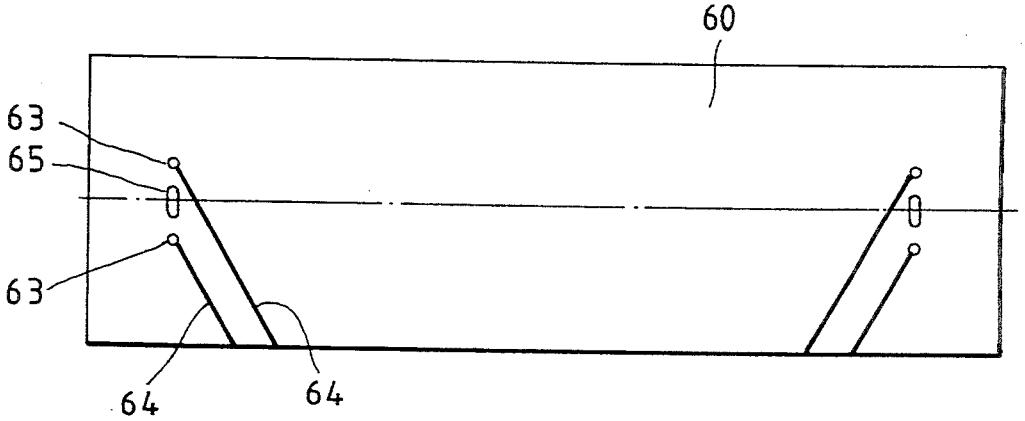
FIG. 17 shows a top plan view of the slat of a fifth preferred embodiment of the present invention.
Figure 18:
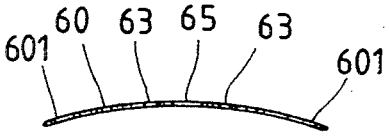
FIG. 18 shows an end view of the slat of the fifth preferred embodiment of the present invention.
Figure 19:
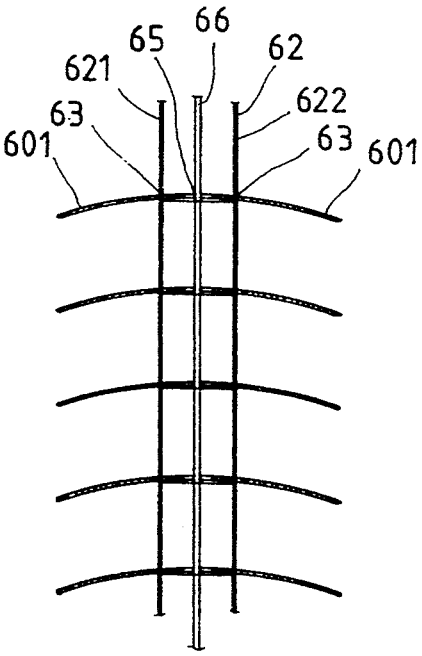
FIG. 19 is a schematic view showing that the slats of the fifth preferred embodiment of the present invention are so set as to allow the light to pass through FIG. 20 is a schematic view showing that the slats of the fifth preferred embodiment of the present invention are so set as to keep out the light.
Figure 20:
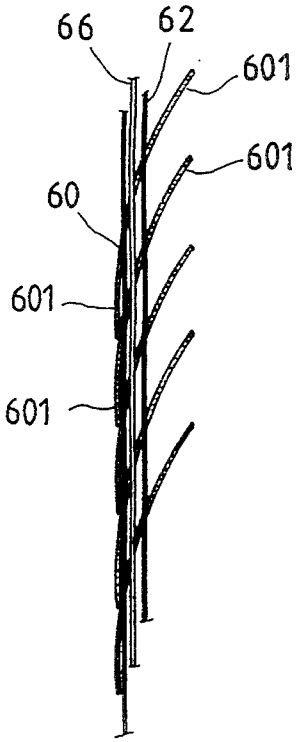

As shown in FIGS. 13 and 16, a slat 50 of the fourth preferred embodiment of the present invention is similar in construction to the slat 40 in that the slat 50 is also provided with two arcuate sections 501 and 502, and with a groove 503, and that the small arcuate section 502 is provided with two ladder holes 53, two slits 54 and two through holes 55. However, the slat 50 is different from the slat 40 in that the small arcuate section 502 is thicker than the large arcuate section 501, so as to strengthen the overall structure of the slat 50.

It must be noted here that the shape and the dimension of the slits 24, 34, 44 and 54 described above may be variable, as long as they permit the suspension cord to pass through. The various modifications in the shape of the slit of the present invention are within the scope of the present invention.

The fifth preferred embodiment of the present invention is illustrated in FIGS. 17–20, in which a slat 60 is shown to comprise dual extension sections 601, and provided with two ladder holes 63 corresponding in location to each ladder 62. The slat 60 is further provided with two slits 64 extending in the same direction from each of the two ladder holes 63. Located between the two ladder holes 63 is a through hole 65 for receiving therein a drawing cord 66. The ladder 62 has two suspension cords 621 and 622, which are respectively received in the two ladder holes 63 via the two slits 64, thereby resulting in the formation of dual extension sections 601 on both sides of the ladder 62. The dual extension sections 601 serve to obstruct the through hole 65 and to conceal the ladder 62 as well as the drawing cord 66 at the time when the slats 60 of the fifth preferred embodiment of the present invention are so set as to keep out the light. In addition, the structural strength of the slat 60 of the fifth preferred embodiment may be reinforced by providing the slat 60 with a multiple arcuate shape or a thicker midsection.

The embodiments of the present invention described above are to be regarded in all respects as merely illustrative and not restrictive. Accordingly, the present invention may be embodied in other specific forms without diviating from the spirit thereof. The present invention is therefore to be limited only by the scope of the following appended claims.

What is claimed is:

1. A Venetian blind comprising:

a top rail;

a tilting device pivoted to said top rail;

two or more ladders, each of which has one end that it fastened to said tilting device and another end that is suspended, each of said ladders further comprising two suspension cords parallel to each other and a plurality of rung sections disposed equidistantly between said two suspension cords;

a bottom rail fastened to a bottom end of each of said ladders such that said bottom rail is parallel to said top rail;

a predetermined number of slats held by said ladders and supported by said rung sections such that said slats are arranged equidistantly and parallel to one another, with each of said slats having two or more through holes, with said through holes of one of said slats being corresponding in location to said through holes of another one of said slats located under said one of said slats, said slats capable of being so set as to permit the light to pass through or to keep out the light by an upward movement or a downward movement of said suspension cords of said ladders actuated by said tilting device;

a predetermined number of drawing cords equal in number to said through holes of said each of said slats, each of said drawing cords having one end fastened to said bottom rail and another end passing through and emerging from said top rail through one of said through holes which is corresponding in location to said each of said drawing cords capable of lifting or lowering said bottom rail; and a drawing cord pulley retainer disposed in one end of said top rail for locating said drawing cords;

wherein each of said slats is provided with a ladder hole corresponding in location to each of said ladders, and with a slit extending from said ladder hole in a predetermined direction; and wherein one of said two suspension cords of each of said ladders is received in said ladder hole through said slit so as to form near said ladder an extension section with an outer side edge capable of forming a lap joint with an inner side edge of said extension section of another one of said slats, with said lap joint serving to obstruct said through holes and to conceal said ladders and said drawing cords;

wherein said slats have a thicker portion provided with said ladder holes, said slits and said through holes.

2. The Venetian blind of claim 1 wherein said ladder hole of said slats is located on one side of and at a predetermined distance from a center line drawn along a longitudinal axis of said slats.

3. The Venetian blind of claim 1 wherein said slats are provided respectively with two ladder holes corresponding in location to each ladder, and with one slit extending from each of said two ladder holes, said ladder having two suspension cords which are received respectively in said two ladder holes through said slit so as to form an extension section on each of both sides of said ladder.

4. The Venetian blind of claim 3 wherein said slit of said slats extends in a predetermined direction, 5. The Venetian blind of claim 1 wherein said through holes are located between two corresponding ladder holes.

6. A Venetian blind comprising:

a top rail;

a tilting device pivoted to said top rail;

two or more ladders, each of which has one end that is fastened to said tilting device and another end that is suspended, each of said ladders further comprising two suspension cords parallel to each other and a plurality of rung sections disposed equidistantly between said two suspension cords;

a bottom rail fastened to a bottom end of each of said ladders such that said bottom rail is parallel to said top rail;

a predetermined number of slats held by said ladders and supported by said rung sections such that said slats are arranged equidistantly and parallel to one another, with each of said slats having two or more through holes, with said through holes of one of said slats being corresponding in location to said through holes of another one of said slats located under said one of said slats, said slats capable of being so set as to permit the light to pass through or to keep out the light by an upward movement or a downward movement of said suspension cords of said ladders actuated by said tilting device;

a predetermined number of drawing cords equal in number to said through holes of said each of said slats, each of said drawing cords having one end fastened to said bottom rail and another end passing through and emerging from said top rail through one of said through holes which is corresponding in location to said each of said drawing cords capable of lifting or lowering said bottom rail; and a drawing cord pulley retainer disposed in one end of said top rail for locating said drawing cords;

wherein each of said slats is provided with a ladder hole corresponding in location to each of said ladders, and with a slit extending from said ladder hole in a predetermined direction; and wherein one of said two suspension cords of each of said ladders is received in said ladder hole through said slit so as to form near said ladder an extension section with an outer side edge capable of forming a lap joint with an inner side edge of said extension section of another one of said slats, with said lap joint serving to obstruct said through holes and to conceal said ladders and said drawing cords;

wherein said slats have a cross section comprising a predetermined number of continuous arcuate portions to form along a longitudinal axis of said slats a predetermined number of grooves parallel to one another for reinforcing a structural strength of said slats.

7. The Venetian blind of claim 6 wherein said slats have a large arcuate section and a small arcuate section which is provided with said ladder holes, said slits and said through holes.

8. The Venetian blind of claim 7 wherein said small arcuate section is thicker than said large arcuate section.

* * * * *